United States Patent [19]

Wieland

[11] 4,302,150

[45] Nov. 24, 1981

[54] CENTRIFUGAL COMPRESSOR WITH DIFFUSER

[75] Inventor: Kurt H. Wieland, Rolling Hills Estates, Calif.

[73] Assignee: The Garrett Corporation, Los Angeles, Calif.

[21] Appl. No.: 38,141

[22] Filed: May 11, 1979

[51] Int. Cl.[3] ..... F04D 29/44

[52] U.S. Cl. ..... 415/207; 415/211

[58] Field of Search ..... 415/207, 211, 219 A

[56] References Cited

U.S. PATENT DOCUMENTS

| | | | |
|---|---|---|---|
| 2,681,760 | 6/1954 | Lundquist | 415/211 |
| 3,197,124 | 7/1965 | Sallou | 415/219 A |
| 3,759,627 | 9/1973 | Ehlinger | 415/219 A |
| 3,778,186 | 12/1973 | Bandukwalla | 415/207 X |
| 3,856,430 | 12/1974 | Langham | 415/207 |
| 3,876,328 | 4/1975 | Exley | 415/211 |
| 3,951,474 | 4/1976 | Hughes et al. | 308/9 |

*Primary Examiner*—Leonard E. Smith

*Attorney, Agent, or Firm*—Stuart O. Lowry; Joel D. Talcott; Albert J. Miller

[57] ABSTRACT

A centrifugal compressor including a one-piece diffuser ring having a circumferentially extending vaneless diffuser space for receiving compressed gas exiting the compressor impeller, and for guiding the compressed gas to a plurality of outwardly extending and circumferentially arranged diffuser channels each of generally circular cross-section.

18 Claims, 6 Drawing Figures

CENTRIFUGAL COMPRESSOR WITH DIFFUSER

BACKGROUND OF THE INVENTION

This invention relates to centrifugal compressors for compressing a gas such as ambient air, refrigerant, or the like. More specifically, this invention relates to an improved unitary diffuser ring for use with a centrifugal compressor for providing improved compressor performance with extended operating range.

Centrifugal compressors are well-known in the art, and comprise a rotatable compressor wheel or impeller for axially receiving air or gas for compression. The impeller is rotatably driven within a compressor housing, and includes axially and radially extending compressor blades for drawing in the gas and for discharging the same radially outwardly at relatively high velocity. The high velocity gas is supplied from the wheel to a so-called diffuser section within the compressor housing which functions to slow the gas velocity thereby converting velocity energy to pressure head. The specific construction of the diffuser section may be varied widely depending upon the specific application or use of the compressor. For example, the diffuser section may be designed for a relatively high overall efficiency over a broad range of operating conditions. Alternately, the diffuser section may be designed for optimum or maximum peak efficiency for a given set of narrow flow conditions and pressure ratios, with some sacrifice in overall flow range capability.

One form of diffuser section for compressors comprises a so-called vaneless diffuser space. The vaneless space typically is formed by a generally toroidal or circumferential compressor housing which circumferentially surrounds the compressor impeller for receiving gas discharged therefrom. The vaneless diffuser space thereby forms a relatively enlarged annular volume receiving the discharged compressed gas whereby the gas velocity is reduced to yield high pressure compressed gas. Diffuser sections including vaneless diffuser spaces are advantageous in that wake effects, sonic shock effects, and the like which may be present in the high velocity and relatively unstable gas flow exiting the compressor impeller are allowed to smooth out and stabilize. This results in a relatively high overall compressor performance over an extended or broad flow range. Accordingly, compressors including vaneless diffuser spaces are desirable in applications wherein the compressor impeller may be driven through a relatively broad speed range. An example of such an application comprises a centrifugal compressor used in automotive turbochargers or the like.

Another common form of diffuser section for centrifugal compressors comprises a vaned or channeled diffuser including a diffuser ring having a plurality of generally outwardly extending radial channels for controllably receiving and expanding gas flow discharged from the compressor impeller. The ring is mounted circumferentially about the impeller, with its channels arranged for centrifugally receiving gas flow. These channels frequently are defined and separated by vanes or the line having a specific and complex leading edge configuration for helping to direct and guide the gas flow. See, for example, U.S. Pat. Nos. 1,291,037; 2,453,524; 2,967,013; 3,644,055, 3,778,186; and 3,904,312. Alternately, the diffuser channels may be defined by relatively complex combinations of passage shapes formed in the diffuser ring for handling the gas flow to meet a specific set of design criteria. See, for example, U.S. Pat. Nos. 2,311,024; 3,604,818; 3,860,360; 3,905,721; 3,964,837; and 4,027,997. In any event, these vaned or channeled diffuser configurations are typically used in relatively constant compressor speed and pressure ratio environments such as in gas turbine engines or the like.

One method of forming a vaned or channeled diffuser configuration comprises the formation of a plurality of radially angled, circumferentially arranged diffuser passages in a diffuser ring, wherein the passages are formed generally to have a circular cross section and to intersect on a common tangency circle. In order to minimize any radial separation between the tips of the impeller blades and the passages, this tangency circle is in the prior art disposed at or very near the blade tips of the impeller. See, for example, U.S. Pat. Nos. 2,708,883; 3,333,762; 3,420,435; 3,876,328; 3,856,430; 3,743,436; and 3,832,089. In this manner, any space between the diffuser ring and the blade tips is substantially minimized or eliminated whereby the compressor may optimally operate at peak efficiency at a given specific set of design conditions. Moreover, this diffuser configuration enables the diffuser ring to be advantageously formed from a single piece with the diffuser passages formed as by drilling or the like, since the step of forming the diffuser passages in the ring simultaneously defines openings extending radially through the ring for open communication with the blade tips.

Some prior art diffuser designs have been proposed seeking to combine a vaneless diffuser space with a circumferentially arranged set of outwardly expanding diffuser channels. These types of combination diffusers are advantageous in certain operating environments wherein a high peak efficiency is desired with at least some broad range operating capability, such as in refrigerant comressors for aircraft and the like. However, this type of combination diffuser design typically requires the diffuser channels to be formed on a tangency circle substantially removed radially outwardly from the diameter of the impeller blade tips in order to adequately define the vaneless diffuser space. This results in the diffuser channels failing to define openings extending radially through the diffuser ring and thereby also failing to communicate with the blade tips of the impellers. To avoid additional machining steps, prior art combination diffusers have not been formed as a single piece design, but instead have comprised multi-piece units requiring bolting or welding for assembly. See, for example, U.S. Pat. No. 4,022,541. However, these multi-piece units are not readily adapted to include circular cross section diffuser channels for optimum diffuser flow and efficiency. Moreover, the diffusers are not as commercially attractive as single piece units, nor are they readily assembled in small sizes for use with relatively small compressor impellers.

This invention comprises an improved combination type diffuser for use with a centrifugal compressor. More specifically, this invention comprises a diffuser ring including a circumferentially disposed vaneless diffuser space for receiving gas flow discharged from a compressor impeller, and for guiding the same for passage to a circumferentially arranged set of outwardly expanding diffuser channels.

SUMMARY OF THE INVENTION

In accordance with the invention, a centrifugal compressor impeller is rotatably received within a compressor housing, and is rotatably driven to compress a working fluid such as ambient air or the like. The impeller, upon rotation, draws in the fluid and discharges it radially outwardly at high velocity into a circumferentially disposed discharge chamber for further supply as by a conduit to apparatus requiring the compressed fluid. A diffuser section includes a unitary generally annular diffuser ring interposed between the impeller and the discharge chamber, and the diffuser ring functions to smoothly guide the fluid flow into the discharge chamber while at the same time reducing velocity energy to substantially increase fluid pressure level.

The diffuser ring includes a plurality of radially angled, generally outwardly extending channels for guiding passage of the fluid outwardly into the discharge chamber. These channels each have a generally circular cross section, and if desired, are formed to expand outwardly from the inner diameter of the diffuser ring. Importantly, these diffuser channels are all uniformly angled with respect to the radial direction such that their centerlines intersect on a common tangency circle. This tangency circle is disposed radially outwardly from the adjacent impeller a radial distance greater than the radius of the channels at the inner diameter of the diffuser ring.

The diffuser channels open at their radially inner ends into a vaneless diffuser space which circumferentially surrounds the adjacent impeller. Discharge fluid from the impeller enters this vaneless diffuser space prior to entry into the diffuser channels whereby flow instability and sonic shock effects are reduced. The side walls of this vaneless space are optimally contoured for a given compression design configuration and impeller characteristics.

BRIEF DESCRIPTION OF THE DRAWINGS

The accompanying drawings illustrate the invention. In such drawings.

DETAILED DESCRIPTION OF THE PREFERRED EMBODIMENT

Figure 1:
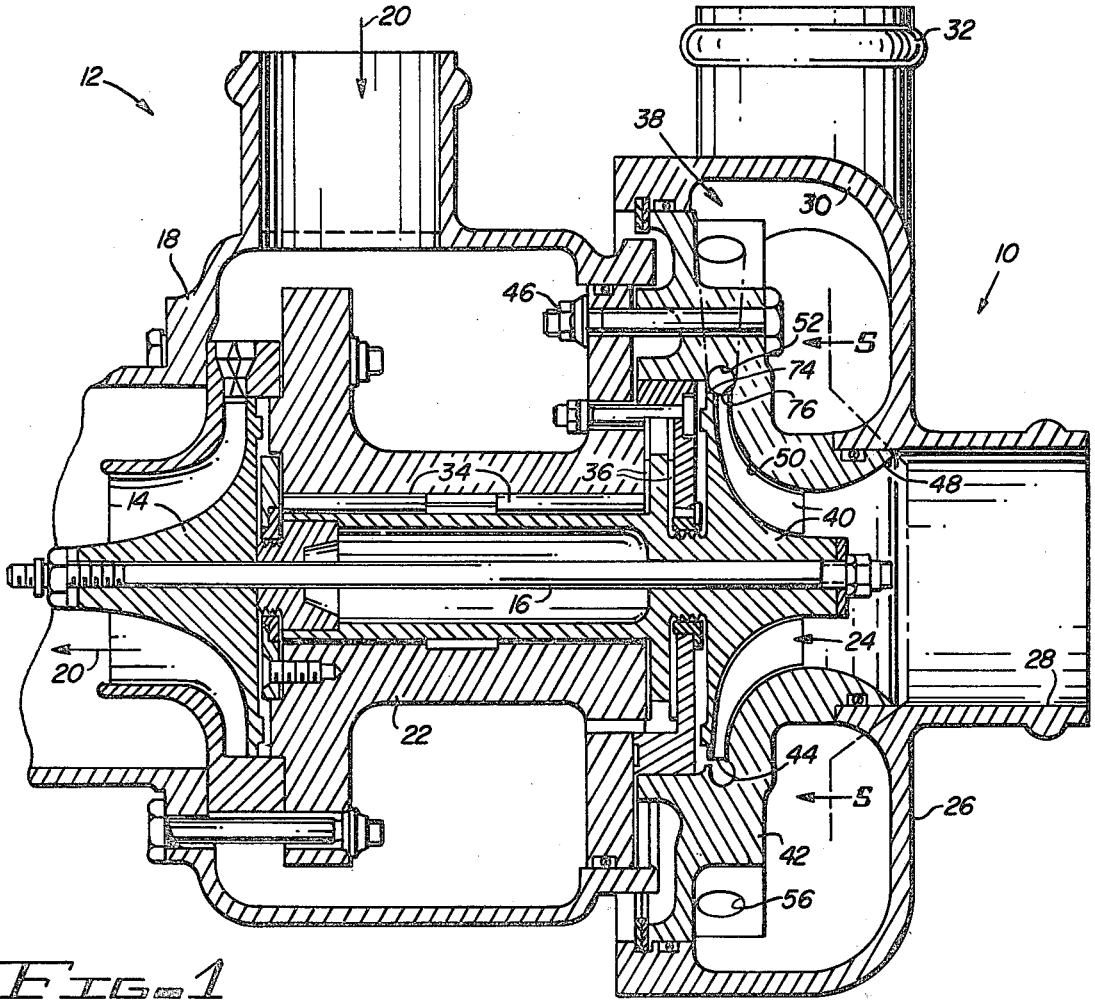
FIG. 1 is a fragmented vertical section of apparatus including a centrifugal compressor of this invention.

A centrifugal compressor 10 of this invention is shown in FIG. 1 in conjunction with a turbo-compressor system 12 for compressing a fluid such as refrigerant or the like. More specifically, the turbo-compressor system 12 comprises a turbine wheel 14 mounted on one end of a rotatable shaft 16 and operably positioned within a turbine housing 18. Driving gases or fluid such as heated exhaust products from a combustion engine (not shown) are supplied as indicated by arrows 20 for expansion through the turbine wheel 14 in order to rotatably drive said turbine wheel. The rotating turbine wheel drives the shaft 16 which is rotatably supported within a center housing 22, and which is connected at its opposite end to a compressor impeller 24 of the centrifugal compressor 10. The thus-driven impeller 24 draws the fluid into a compressor housing 26 through an inlet 28, and functions to deliver compressed fluid radially outwardly into a discharge chamber 30 of the compressor housing 26. From here, the compressed fluid is suitably coupled to equipment or apparatus requiring the compressed fluid, as by an outlet 32.

As illustrated in FIG. 1, the shaft 16 is rotatably supported within the center housing 22 by suitable journal bearings 34 and thrust bearings 36. Conveniently, for long life operation at high rotational speeds, the bearings 34 and 36 desirably comprise process fluid bearings. While the specific structure of these process fluid bearings is not shown or described in detail, it is contemplated that the bearings will be configured generally as disclosed in U.S. Pat. Nos. 3,215,480; 3,366,427; 3,375,046; 3,382,014; 3,434,762; 3,615,121; 3,635,534; 3,642,331; 3,677,612; 3,893,733; 3,951,474; and 3,957,317, all assigned to the assignee of this application and incorporated by reference herein.

The centrifugal compressor 10 of this invention includes a diffuser section 38 for receiving compressed fluid discharged radially outwardly from the blades 40 of the impeller 24. The diffuser section 38 comprises a generally annular diffuser ring 42, which circumferentially surrounds the radial tips 44 of the impeller blades 40, and is specifically contoured to smoothly guide the fluid radially outwardly into the circumferentially disposed fluid discharge chamber 30 formed in the compressor housing 26. The contoured diffuser ring 42 is configured to smooth out and stabilize the high velocity fluid flow exiting the impeller blades 40, and to reduce the velocity of the radially outwardly flowing fluid to convert kinetic velocity energy to a relatively high pressure head. In this manner, the diffuser ring 42 enhances overall operation, efficiency, and flow range of the centrifugal compressor 10.

As shown in the drawings, the diffuser ring 42 comprises a generally annular-shaped insert mounted within the compressor housing 26 as by a plurality of bolts 46. The ring 42 includes an inlet throat 48 which aligns with the inlet 28 of the compressor housing 26, and is curvedly contoured for smooth flow-efficient guiding of the fluid into communication with the rotating compressor impeller 24. The inlet throat 48 of the ring 42 is contoured to closely correspond with the cross-sectional configuration of the blades 40 of the impeller 24, and then blends with a fluid discharge portion 50 directed in a radially outward direction.

At the radial tips 44 of the impeller blades 40, the diffuser ring 42 defines a vaneless diffuser space 52 which circumferentially surrounds the impeller 24. This vaneless diffuser space comprises a vaneless volume generally of circular cross section in open communication with the blade tips 44 via a radially inward throat 54. Compressed fluid discharged radially outwardly from the blade tips 44 initially passes into the vaneless diffuser space 52 which, by virtue of its lack of vanes or other structural barriers, serves to smooth out wake and sonic shock effects inherent in the high velocity fluid flow, and to generally stabilize the flow conditions.

The vaneless diffuser space 52 communicates with a plurality of generally radially outwardly extending diffuser channels 56 formed in the diffuser ring 42. As shown in FIGS. 1, 2, 5, and 6, these diffuser channels are angled with respect to the radial direction, and provide open communication between the vaneless diffuser space 52 and the fluid discharge chamber 30 of the compressor housing 26. Moreover, as shown, these diffuser channels 56 are formed to have a circular cross section along their lengths for optimum fluid flow characteristics. The channels 56 also are formed to expand outwardly toward the compressor housing discharge chamber 30 over at least a portion of their lengths, as illustrated by the conical sections 58 shown in FIGS. 5 and 6. Alternately, the channels 56 may be formed entirely as conical portions to expand outwardly over their entire lengths, if desired.

Figure 5:
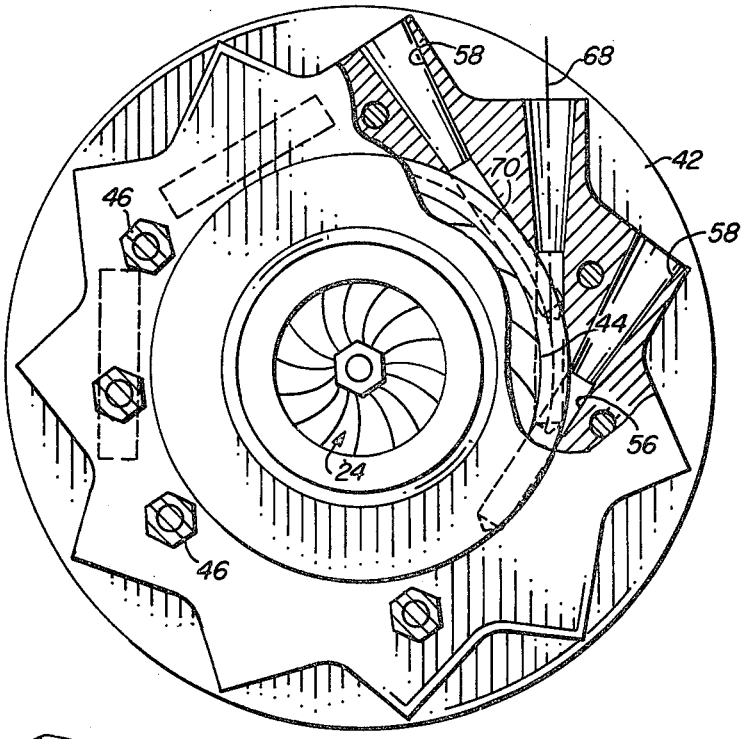
FIG. 5 is a fragmented vertical section taken on the line 5—5 of FIG. 1, with portions broken away.
Figure 6:
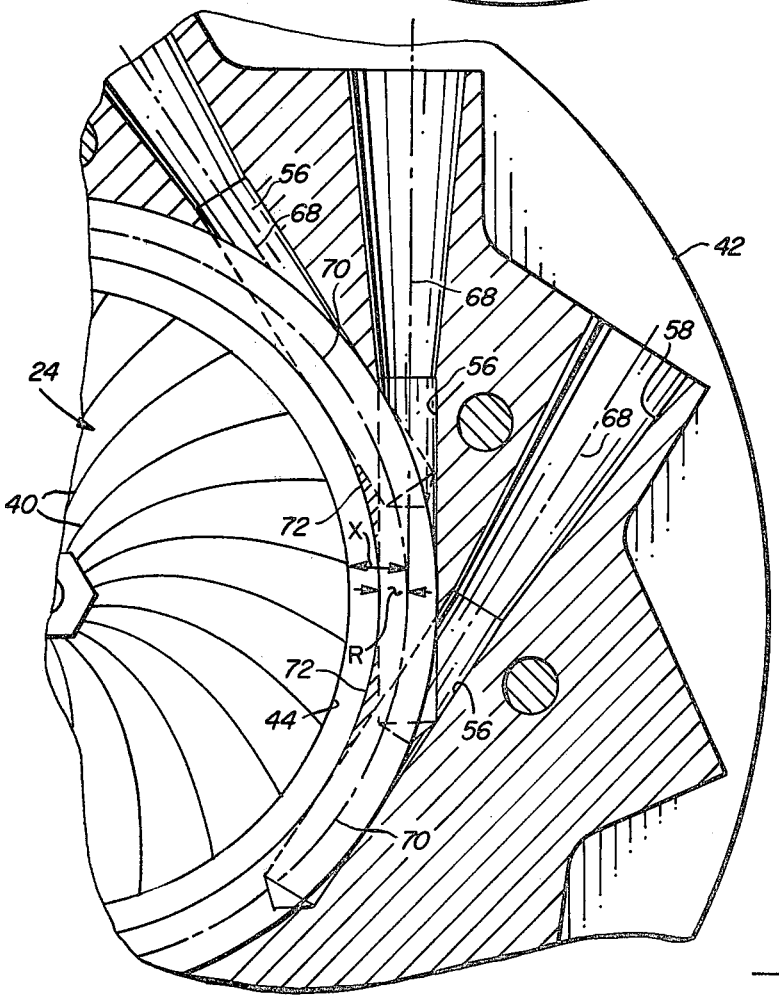
FIG. 6 is an enlarged fragmented view of a portion of FIG. 5.

As shown in FIGS. 5 and 6, the diffuser channels 56 are angled with respect to the radial direction, and have the centerlines 68 of their circular cross sections disposed on a common imaginary tangency circle 70. The position of the tangency circle 70 is governed by precise limits so as to assure optimum compressor efficiency with at least some adaptability to broad flow range operation. More specifically, the tangency circle 70 is disposed radially outwardly from the radial tips 44 of the compressor impeller blades 40 so as to adequately separate the diffuser channels 56 and corresponding diffuser ring material radially outwardly from the blade tips 44. Indeed, the tangency circle 70 is radially separated from the blade tips 44 by a distance "X" (FIG. 6) which is at least greater than the radius "R" of the diffuser channels 56 at their radially inner ends. With this limitation, the diffuser channels 56 are sufficiently separated from the blade tips 44 to define a functional vaneless diffuser space 52 between the blade tips 44 and the diffuser channels 56. Of course, the tangency circle 70 may be located radially outwardly at varying distances greater than the dimension "R" depending upon the desired operating characteristics of the particular centrifugal compressor 10.

Figure 2:
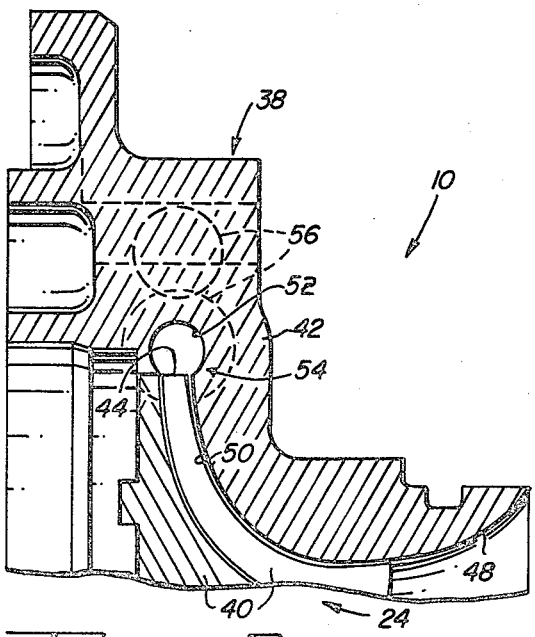
FIG. 2 is an enlarged fragmented view of a portion of FIG. 1.
Figure 3:
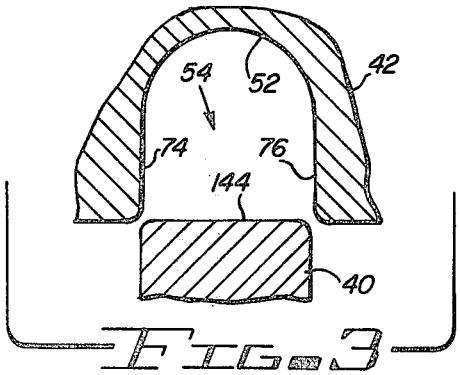
FIG. 3 is an enlarged fragmented view similar to a portion of FIG. 2, and illustrating an alternate embodiment of the invention.

The above-defined disposition of the diffuser channels 56 results in some discontinuities or ridges 72 within the area of the vaneless diffuser space 52 when the diffuser channels 56 are formed as by drilling or the like. Depending upon the desired operating characteristics of the centrifugal compressor 10, these ridges 72 may be left in place. However, these ridges 72 may be advantageously removed for many applications, wherein the steps of removing or machining these ridges 72 may further be used to uniquely contour the inlet throat 48 of the vaneless diffuser space 52 to meet specific compressor operating requirements. That is, as shown in FIGS. 1 and 2, the inner wall 74 and the outer wall 76 may be machined flat to remove the ridges and to yield surfaces perpendicular to the axis of impeller rotation. The specific depth of these flat machine cuts may be selected to match and align with the axial width of the blade tips 44, and thereby specifically match the particular compressor impeller 24 which has been chosen for a particular compressor environment. As shown in FIG. 3, the depth of the flat machine cuts may be varied considerably for wider blade tips 144 of an alternate compressor impeller.

Figure 4:
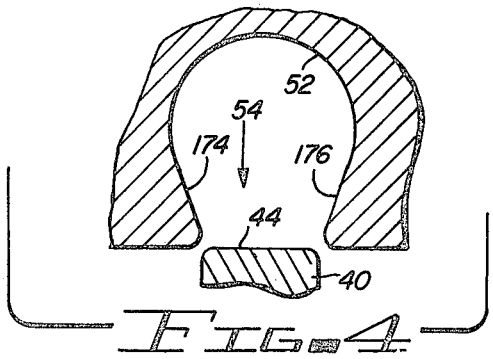
FIG. 4 is an enlarged fragmented view similar to FIG. 3, and illustrating another embodiment of the invention.

Various other inner wall 74 and outer wall 76 configurations may be chosen to yield specific diffuser ring operating characteristics and to match the particular compressor impeller. As shown in FIG. 4, one such alternate wall configuration comprises outwardly tapered walls 174 and 176 adapted to blend smoothly between relatively narrow width blade tips 44 and the circular cross section vaneless diffuser space 52. Of course, various other wall contour configurations are possible, and in some instances, it may be desirable to mix wall contours so as to form, for example, one flat wall and one tapered wall.

The diffuser ring 42 may be adapted to meet a desired set of operating characteristics depending upon the specific impeller 24 chosen for a particular application. For example, while the ring 42 shown in FIG. 5 shows eleven different locations for diffuser channels, it is to be understood that the number of channels 56 actually formed in the ring 42 will depend upon the operating characteristics desired. Moreover, the channels 56 themselves may be formed of various sizes and outwardly expanding taper configurations.

The centrifugal compressor 10 of this invention thus includes a uniquely contoured unitary diffuser ring 42 including a defined vaneless diffuser space 52 for guiding compressed fluid flow to a plurality of radially outwardly expanding diffuser channels of circular cross section. The ring 42 is readily adapted for removal of any ridges 72 resulting from formation of the channels 56 to yield a vaneless diffuser space throat area 48 which is specifically tailored to provide a desired set of operating characteristics. The result is a combination-type diffuser ring 42 which may be advantageously formed as a single piece to provide relatively high peak compressor efficiency by virtue of the channels 56 together with reasonable broad flow range capacity by virtue of the vaneless diffuser space 52.

It is to be understood that various other modifications and improvements of the invention set forth herein are believed to be possible within the skill of the art. Accordingly, no limitation of the invention is intended by way of the description herein, except as set forth in the appended claims.

What is claimed is:

1. In a centrifugal compressor having a centrifugal impeller rotatably carried within a compressor housing having an annular chamber for receiving compressed fluid discharged radially outwardly from said impeller upon impeller rotation, a diffuser section comprising a unitary diffuser ring closely and circumferentially surrounding said impeller between said impeller and the discharge chamber, said ring including an annular vaneless diffuser space having a generally circular cross section openly communicating with said impeller for receiving fluid discharged radially outwardly from said impeller via a radially inwardly open throat, said throat having an axial width generally corresponding to the axial width of the radially outward extent of said impeller, and a plurality of linearly extending, generally circular cross section diffuser channels radiating generally outwardly from the vaneless diffuser space for guiding fluid from the vaneless space to the discharge chamber, said diffuser channels expanding radially outwardly over at least a portion of their lengths and being angularly oriented with respect to each other for intersection of their linear centerlines to form a tangency circle within said vaneless diffuser space and disposed radially outwardly from the radially outward extent of said impeller by a radial dimension greater than the radius of the diffuser channels at the innermost diameter of said channels.

2. A centrifugal compressor comprising a centrifugal impeller; a compressor housing receiving said impeller and including an annular discharge chamber for receiving compressed fluid discharged radially outwardly from said impeller upon impeller rotation; a shaft coupled to said impeller; process fluid bearing means for rotatably supporting said shaft; and a unitary diffuser ring closely and circumferentially surrounding said impeller between said impeller and the discharge chamber, said ring including an annular vaneless diffuser space having a generally circular cross section openly communicating with said impeller for receiving fluid discharged radially outwardly from said impeller via a radially inwardly open throat, said throat having an axial width generally corresponding to the axial width of the radially outward extent of said impeller, and a plurality of linearly extending, generally circular cross section diffuser channels radiating generally outwardly from the vaneless diffuser space for guiding fluid from the vaneless space to the discharge chamber, said diffuser channels expanding radially outwardly over at least a portion of their lengths and each being angularly oriented at an acute angle with respect to adjacent diffuser channels for intersection of their linear centerlines to form a tangency circle within said vaneless diffuser space and disposed radially outwardly from the radially outward extent of said impeller by a radial dimension greater than the radius of the diffuser channels at the innermost diameter of said channels.

3. In a centrifugal compressor having a centrifugal impeller rotatably carried within a compressor housing having an annular discharge chamber for receiving compressed fluid discharged radially outwardly from said impeller upon impeller rotation, a diffuser section comprising an annular unitary diffuser ring closely circumferentially surrounding said impeller between said impeller and the discharge chamber, said ring including an annular vaneless diffuser space in open communication with said impeller for receiving fluid discharged radially outwardly from the impeller, and a plurality of linearly extending, generally outwardly radiating diffuser channels of generally circular cross section for guiding fluid from the vaneless diffuser space to the discharge chamber, said diffuser channels being angularly oriented with respect to each other for intersection of their linear centerlines to form a tangency circle within said vaneless diffuser space and disposed radially outwardly from said impeller by a radial dimension greater than the radius of the diffuser channels.

4. A diffuser section as set forth in claim 3 wherein the vaneless diffuser space is formed to have a generally circular cross section, and a radially inwardly open throat for providing open communication between said impeller and the circular cross section portion of the vaneless diffuser space, and wherein the axial width of the throat generally corresponds with the axial width of the radially outer extent of the impeller.

5. A diffuser section as set forth in claim 4 wherein the vaneless diffuser space throat is defined by axially inner and outer walls, and wherein said inner and outer walls are contoured to match the operating characteristics of the associated impeller.

6. A centrifugal compressor comprising a centrifugal impeller rotatably carried within a compressor housing having an annular discharge chamber for receiving compressed fluid discharged radially outwardly from said impeller upon impeller rotation; and a unitary diffuser ring closely and circumferentially surrounding said impeller between said impeller and the discharge chamber, said ring including an annular vaneless diffuser space having a generally circular cross section openly communicating with said impeller for receiving fluid discharged radially outwardly from said impeller via a radially inwardly open throat, said throat having an axial width generally corresponding to the axial width of the radially outward extent of said impeller, and a plurality of linearly extending, generally circular cross section diffuser channels radiating generally outwardly from the vaneless diffuser space for guiding fluid from the vaneless space to the discharge chamber, said diffuser channels expanding radially outwardly over at least a portion of their lengths and being angularly oriented with respect to each other for intersection of their linear centerlines to form a tangency circle within said vaneless diffuser space and disposed radially outwardly from the radially outward extent of said impeller by a radial dimension greater than the radius of the diffuser channels at the innermost diameter of said channels.

7. A centrifugal compressor as set forth in claim 6 including a shaft coupled to said impeller, housing means receiving said shaft, and process fluid bearing means for rotatably supporting said shaft with respect to said housing means.

8. A centrifugal compressor as set forth in claim 6 wherein the vaneless diffuser space throat is defined by axially inner and outer walls, and wherein said inner and outer walls are contoured to match the operating characteristics of the associated impeller.

9. A centrifugal compressor including a compressor housing having an annular discharge chamber for receiving compressed fluid, comprising a centrifugal impeller rotatably carried within the compressor housing for discharging compressed fluid radially outwardly to the discharge chamber upon impeller rotation; and an annular diffuser ring of unitary construction closely circumferentially surrounding said impeller between said impeller and the discharge chamber, said ring including an annular vaneless diffuser space in open communication with said impeller for receiving fluid discharged radially outwardly from the impeller, and a plurality of linearly extending, generally outwardly radiating diffuser channels of generally circular cross section for guiding fluid from the vaneless diffuser space to the discharge chamber, said diffuser channels being angularly oriented with respect to each other for intersection of their linear centerlines to form a tangency circle within said vaneless diffuser space and disposed radially outwardly from said impeller by a radial dimension greater than the radius of the diffuser channels.

10. A centrifugal compressor as set forth in claim 9 wherein the diffuser channels are formed to have a generally radially outwardly expanding conical configuration, and wherein the tangency circle is disposed radially outwardly from said impeller by a radial dimension greater than the radius of the diffuser channels at the innermost diameter of said channels.

11. A centrifugal compressor as set forth in claim 9 wherein the diffuser channels are formed to have a generally cylindrical portion communicating with the vaneless diffuser space, said cylindrical portion blending into a radially outwardly expanding generally conical portion communicating with the discharge chamber.

12. A centrifugal compressor as set forth in claim 9 including means for rotatably driving said impeller.

13. A centrifugal compressor as set forth in claim 12 wherein said driving means includes a shaft coupled to said impeller, and including housing means receiving said shaft, and process fluid bearing means for rotatably supporting said shaft with respect to said housing means.

14. A centifugal compressor as set forth in claim 9 wherein the vaneless diffuser space is formed to have a generally circular cross section, and a radially inwardly open throat for providing open communication between said impeller and the circular cross section portion of the vaneless diffuser space.

15. A centrifugal compressor as set forth in claim 14 wherein said impeller includes a plurality of contoured impeller blades for drawing fluid axially inwardly upon impeller rotation and for discharging the fluid in a compressed state radially outwardly, said blades having at their radially outward extent an axial width corresponding generally to the axial width of the vaneless diffuser space throat.

16. A centrifugal compressor as set forth in claim 14 wherein the vaneless diffuser space throat is defined by axially inner and outer walls, and wherein said inner and outer walls are contoured to match the operating characteristics of the associated impeller.

17. A centrifugal compressor as set forth in claim 16 wherein said inner and outer walls are formed to extend generally radially with respect to the axial direction of impeller rotation.

18. A centrifugal compressor as set forth in claim 16 wherein said inner and outer walls are formed to extend angularly with respect to the radial direction.

* * * * *